United States Patent [19]

Simonen

[11] Patent Number: 5,022,331

[45] Date of Patent: Jun. 11, 1991

[54] METHOD AND APPARATUS FOR INTRODUCING COMBUSTION AIR INTO A FURNACE

[75] Inventor: Liisa I. Simonen, Marietta, Ga.

[73] Assignee: A. Ahlstrom Corporation, Finland, Finland

[21] Appl. No.: 505,696

[22] Filed: Apr. 6, 1990

[30] Foreign Application Priority Data

Apr. 10, 1989 [FI] Finland ..... 891685

[51] Int. Cl.[5] ..... F23L 15/00

[52] U.S. Cl. ..... 110/297; 110/234; 110/348; 122/7 C

[58] Field of Search ..... 110/297, 234, 308, 309, 110/348; 122/7 C; 431/176, 180

[56] References Cited

U.S. PATENT DOCUMENTS 3,413,936 12/1968 Matthews ..... 122/7 C X 4,823,710 4/1989 Garrido et al. ..... 110/297 X

FOREIGN PATENT DOCUMENTS 175470 5/1961 Sweden ..... 110/297

OTHER PUBLICATIONS

"Flow and Mixing in Kraft Recovery Boilers", by Terry N. Adams from Black Liquor Combustion Seminar Report; pp. 66–91, 1988.

*Primary Examiner*—Edward G. Favors

*Attorney, Agent, or Firm*—Nixon & Vanderhye

[57] ABSTRACT

A method and apparatus for introducing combustion air in the form of air jets into a furnace (2) of, for example, a soda recovery boiler. Combustion air is introduced through air ports (12), arranged substantially at the same level (10), in air jets (13) of at least two sizes. Air ports in the walls (4) of the furnace are dimensioned in different sizes such that their hydraulic diameters increase from the corners of the furnace towards the centers of the furnace walls, whereby the degree of penetration of the respective air jets flowing through the air ports increases. The penetration of the air jets in maintained constant at different loading conditions.

17 Claims, 6 Drawing Sheets

METHOD AND APPARATUS FOR INTRODUCING COMBUSTION AIR INTO A FURNACE

BACKGROUND AND SUMMARY OF THE INVENTION

The present invention relates to a method and apparatus for introducing combustion air into a furnace. More specifically, the invention relates to the introduction of combustion air through air ports which are located substantially at the same level in the different walls of the furnace. The walls of the furnace have several such air ports located adjacent each other and at the same level, which air ports communicate with air supply means for introducing combustion air to the furnace.

An optimal supply of combustion air in the lower part of the furnace plays a substantial role in the control of a combustion process in the combustion chamber of a boiler. An exemplary process in this regard is the burning of black liquor in a soda recovery boiler.

Since the chemical reactions in the soda recovery boiler are very rapid, the speed of the process becomes substantially dependent on the mixing of combustion air and black liquor. This mixing step determines the burning rate and also affects the process efficiency. Air and black liquor are typically introduced to the boiler through individual ports, and it is especially important that a rapid mixing in the boiler is caused by the air supply. The burning symmetry must be controlled throughout the whole cross-sectional area of the boiler and the air supply must be adjusted when required.

Black liquor is generally introduced in the form of considerably large droplets into a soda recovery boiler so as to facilitate the downward flow of the droplets, and to prevent them from flowing, unreacted (as fine fume) upwards together with the upwardly flowing gases to the upper part of the boiler. The large droplet size, which results in the droplets being spaced further from each other than in a fine black liquor spray, means that proper mixing is even more important in a soda recovery boiler.

A stoichiometric amount of air, relative to the amount of black liquor, is introduced into a soda recovery boiler and additionally, a surplus amount of air is supplied to ensure complete combustion. Too much excessive air, however, causes a loss in efficiency of the boiler and an increase in costs. Air is usually introduced into the boiler at three different levels: primary air at the lower part of the furnace, secondary air above the primary air level but below the liquor nozzles, and tertiary air above the liquor nozzles to ensure complete combustion. Air is usually introduced through several air ports located in all four walls, or only in two opposing walls of the furnace.

In a soda recovery boiler, an uneven or inefficient supply of secondary air gives especially poor results in combustion, clogs the heat surfaces and increases emissions in flue gases. The flow of secondary air must be adjusted in such a way that volatile and gasifying particles from the black liquor mix optimally with the combustion air and do not leave the boiler unburnt, which, of course, would decrease the efficiency of the combustion process. Moreover, the volatile and fume particles can very easily cause fouling of heat recovery surfaces in heat recovery devices connected to the boiler. Any unreacted particles escaping from the boiler also increase undesirable and/or harmful emissions.

It has been discovered that especially in boilers having large diameters, in which the cross-sectional area of the furnace is approximately 10 m×10 m or even more, the penetration of air to the center parts of the boiler is insufficient and difficult to control. Moreover, it has been observed that in a square boiler, air flows supplied in perpendicular directions from the corners of the boiler tend to partially eliminate each other's penetration into the boiler.

FIG. 1 schematically illustrates, how conventional air flows from four different sides or walls of a furnace are distributed in the cross-sectional area of the boiler. Occasionally relatively large empty areas A are formed between the air flows. On the other hand, there is also considerable interlacing B of the air flows. Thus, air flows unevenly over the cross-sectional area of the boiler. As will be appreciated from FIG. 1, some areas remain without any combustion air, whereas other areas receive surplus amounts of air.

Attempts have been made to improve the situation by increasing the number of ports, as illustrated in FIG. 2. Thus, it is possible to diminish the empty areas in the corners. The amount of combustion air available, however, is restricted in order to achieve an optimal combustion efficiency. By increasing the number of air ports, it is possible to achieve with the same amount of combustion air a more uniform air supply close to the walls and corners of the boiler, but as the penetration of air correspondingly must be diminished, an area is formed in the center of the boiler into which air does not reach.

In order to achieve a more uniform supply of secondary air, each air port is adjusted separately so as to avoid surplus amounts of air in the corner areas. It is the usual practice that the air ports in a soda recovery boiler are provided with manual dampers so that the air pressure may be adjusted, if necessary. The control of the air pressure is carried out by varying the open surface area of the air ports either individually at each air port, or at several air ports at the same time. Thus, it is possible, to some extent, to adjust the flow rate of the air being introduced, but it is not possible at all loads to maintain the air penetration to the center area of the boiler in the secondary zone constant. For example, when operating with full load, when all ports are fully open, there is no further possibility for adjustment.

The use of dampers for constricting the air ports, however, is very problematic. When the opening is constricted, the air flow flowing through the air port is not sufficient to cool either the opening or the damper, which warms up and burns off, either completely or partially.

Mixing becomes difficult also because of the upflow of gas which forms in the center part of the boiler, through which it is difficult for the weak secondary air flow to penetrate. More specifically, the primary air flows, supplied from the sides in the bottom part of the boiler, collide with each other in the center part of the boiler and form, in the center part of the boiler, a gas flow flowing very rapidly upwards, catching flue gases and other incompletely burnt gaseous or dusty material from the lower part of the furnace. This gas flow, also called a "droplet lift", also catches countercurrently downwards flowing black liquor particles and carries them to the upper part of the boiler, where they stick to the heat surfaces of the boiler, causing fouling and clogging. In the center part of the boiler, the speed of the upwards flowing gas may become as much as four times as great as the average speed of the gases as a result of incomplete or weak mixing. Thus a zone of rapid flow is formed in the center part of the boiler, and this renders mixing of flue gases from the side of the flow very difficult to achieve.

The object of the present invention is to increase the capacity and energy efficiency of the boiler by improving the supply of the combustion air. More specifically, the principal purpose is to produce an air supply in the furnace which is more uniform than that in the known techniques, and which better covers the entire cross-sectional area of the boiler.

Another object of the present invention is to enable a constant penetration of combustion air into the boiler at different loading levels.

Especially where soda recovery boilers are concerned, an additional object is to produce a better mixing of black liquor and combustion air in the furnace. Yet another object is to reduce the harmful effect of the above mentioned "droplet lift" effect. Finally, the improved air supply arrangement of this invention is also designed to reduce the amount of harmful emissions.

In order to achieve the above mentioned objects, the method in accordance with the present invention is characterized in that combustion air is introduced into a furnace from at least two opposing walls in air jets of at least two sizes, and in such a way that the penetration of the air jets introduced from different air ports increases from the corners of the furnace walls towards the center of the walls. Combustion air is supplied in a soda recovery boiler in jets of different sizes advantageously from all four furnace walls, such that the penetration of air jets is maintained higher in the center parts of the furnace walls than in the corner parts of the furnace. The penetration of air from different air ports is maintained substantially constant so that the air jets cover the entire cross-sectional area of the furnace as uniformly as possible at different loading conditions without forming any interlacing of air flows or leaving any significant open areas between the air jets.

The apparatus in accordance with the present invention is characterized in that the hydraulic diameter of the air ports in the walls of the furnace increases when moving from the corners of the furnace walls towards the center of the furnace walls. In one exemplary embodiment, the relative area of the air ports may be increased from the corner towards the center of the furnace wall by increasing the cross-sectional areas of the ports. The hydraulic diameter may also be increased by providing at least two small air ports arranged within the effective range of each other toward the center of the wall of the furnace so that the combined hydraulic diameter of the two small ports is greater than the hydraulic diameter of other ports arranged close to the corner, or greater than the combined hydraulic diameter of like groups of closely related air ports. By increasing the relative number of air ports by arranging two or three air ports of, for example, the same size and within a very short distance of each other so that they, in practice, form a combined uniform air port, it is possible to increase the penetration of air in a particular area of the furnace.

The air ports in accordance with the present invention may be arranged at a horizontal level in similar or different intervals in the walls of the furnace or boiler. For example, in a soda recovery boiler, it may be advantageous to arrange small openings close to the corners of the boiler at smaller intervals than larger openings located toward the center of each of the boiler walls.

The air ports in accordance with the present invention are advantageously arranged at substantially the same level, but they may, of course, be arranged at slightly different levels when required.

In a preferred embodiment of the invention, secondary air port zones are provided in all four walls of a soda recovery boiler. The areas of the openings in air ports in the secondary air nozzles at one level of the soda recovery boiler are dimensioned so that the areas of the openings close to the corners are smaller than those of the openings in the center parts of the wall. Thus a sufficient penetration of air is achieved in the center parts of the boiler and without the disadvantages of conventional apparatus. A good mixing of combustion air also facilitates the formation and control of a bed at the bottom of the furnace.

The above described differential in cross-sectional areas of the flow openings increases the penetration range of air introduced into the boiler. The relationship between the penetration range of air, the hydraulic diameter of the openings, temperatures of air and gas as well as flow rates may be illustrated by a mathematical formula as follows:

$$L_p = k \times D_n \times V_n / V_f \times (T_f / T_n) n$$

where

Lp = penetration range of an air jet k = empirical constant $D_n$ = hydraulic diameter of an opening $V_n$ = flow rate of air in the opening $V_f$ = upflow speed of gas in the boiler $T_n$ = temperature of inlet air $T_f$ = temperature of gas in the furnace, and n = empirical constant, typically 0.5

It can seen in the formula that the penetration range is directly proportional to the hydraulic diameter of the opening. In other words, by enlarging the opening, the penetration range is increased. The air ports may be dimensioned according to the formula to produce a symmetric airsupply throughout the entire cross-sectional area of the boiler at constant conditions. At different running conditions, air penetration is maintained constant by adjusting the penetration range by adjusting either the hydraulic diameters of the openings, the air flow in the openings or the temperature of the inlet air. By adjusting the air penetration $L_p$ as a function of flow rate $V_n$ and/or the temperature $T_n$, it is possible to run the boiler according to the invention at overload without losing the uniform supply of combustion air.

In accordance with this invention, it is possible to use dampers to adjust the hydraulic diameters of the air inlet openings. Dampers are used to adjust the air flow rate as appropriate when the loading conditions change. Because the openings are already correctly dimensioned, it is not necessary to adjust individual openings at standard conditions. The openings in the corner areas of the furnace are dimensioned for weak air flows, and it is thus not necessary in the applications in accordance with the invention to constrict the openings so much that the constriction valves would be as exposed to burning as in the air registers according to the prior art.

Air is introduced to the air ports from wind boxes, from which air is generally simultaneously conducted to several air ports. By adjusting the air pressure in the wind box, it is possible simply to adjust the speed of the air in the air port and thus affect the penetration of air.

A previous Finnish patent FI 65098 illustrates a method by which it is possible to adjust the air ports of a soda recovery boiler in each wall at the same time by using a main shaft. This joint control method is appropriate especially in the apparatus in accordance with the present invention. All dampers in one wall move at the same pace, whereby, when the load of the boiler changes, the adjustment may be made merely by control instructions to the actuator of the main shaft. It is not necessary to change the air supply profile. Similarly, it is simple to control the total amount of air and/or the speed of air at each wall in such a way that the desired combustion result is achieved. Combining the use of the main shaft with an automatic control is simple, and the control parameter may be, for example, the pressure measured in the air nozzles, the amount of the upwards gas flow coming from below, or parameters affecting the air penetration.

Other objects and advantages of the invention will become apparent from the detailed description which follows.

DETAILED DESCRIPTION OF THE DRAWINGS

Figure 1:
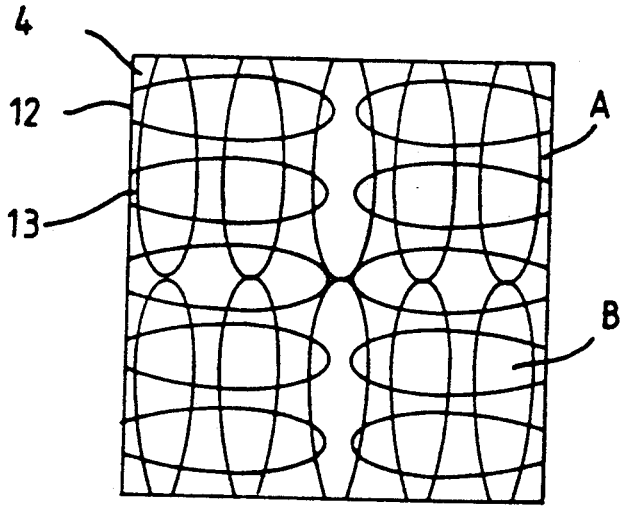
FIGS. 1 and 2 illustrate the penetration capability of air jets over the cross-sectional area of the boiler in accordance with the prior art, as described above.
Figure 2:
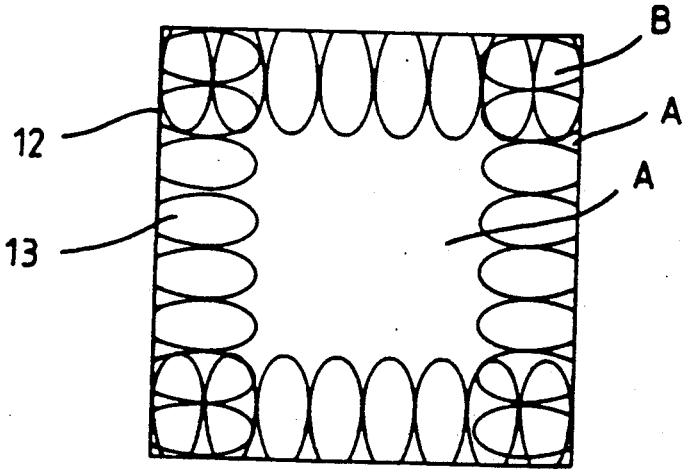
Figure 3:
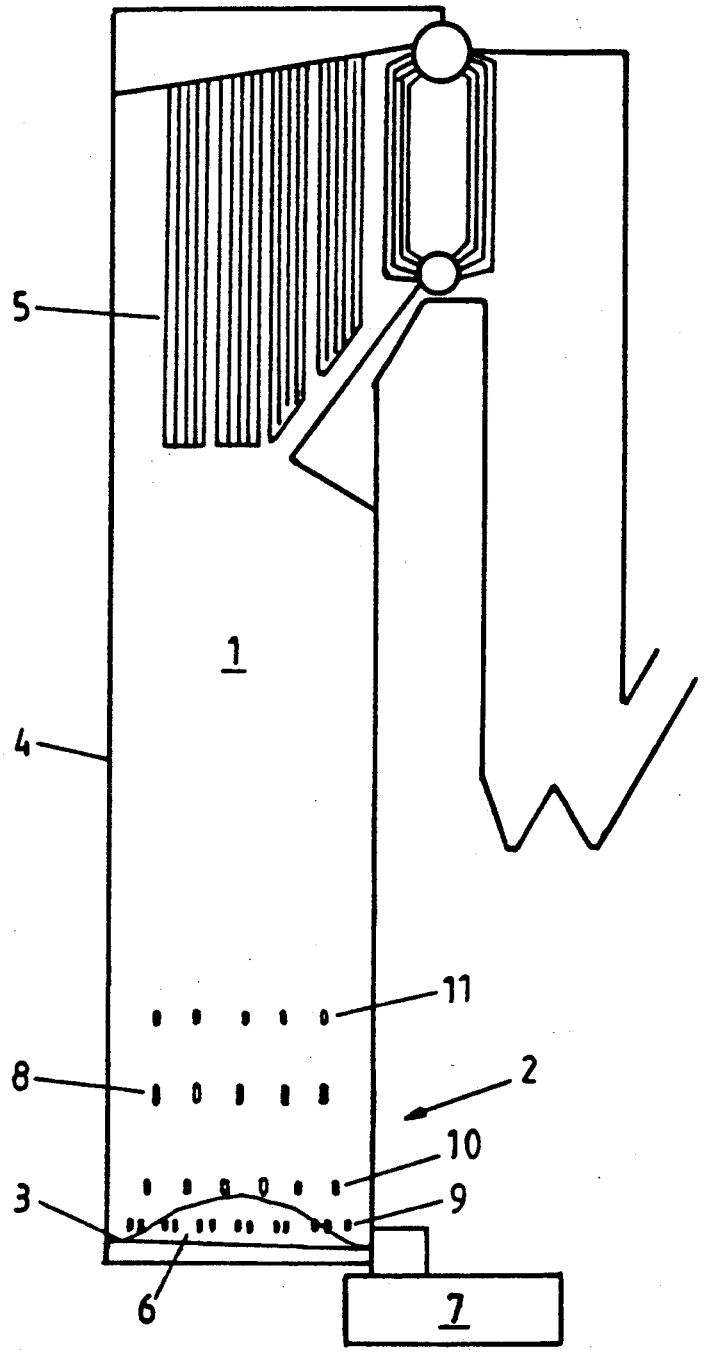
FIG. 3 illustrates a schematic cross-sectional view of a soda recovery boiler.

A soda recovery boiler 1 in accordance with FIG. 3 comprises a furnace 2 provided with a bottom 3, boiler walls 4, and a super heater 5. In the combustion process, a bed of dried and partly burnt black liquor is formed at the bottom of the furnace. Melt chemicals flow through the porous bed to the bottom of the furnace, from where they are transferred as an overflow via melt chutes to a dissolving tank 7. Black liquor is introduced to a soda recovery boiler by liquor injections through openings in zone 8. Air is introduced from three different levels: primary air register 9, secondary air register 10 and tertiary air register 11. Oval air ports 12 in the secondary air register 10 differ in size compared with each other as explained in greater detail.

Figure 4:
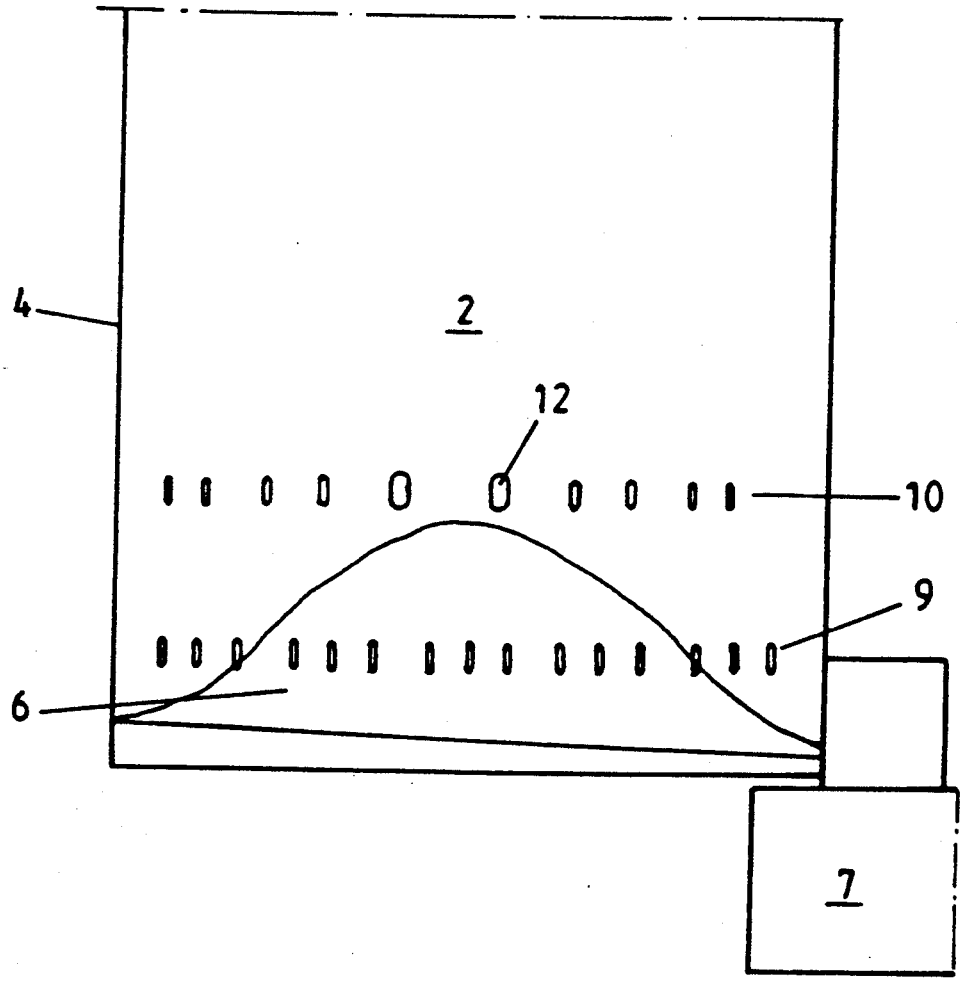
FIG. 4 illustrates an enlargement of supply port zones for primary and secondary air of a soda recovery boiler.

FIG. 4, which illustrates an enlargement of the primary and secondary air registers 9 and 10, respectively, shows that air ports 12 close to the corners of the boiler are smaller than the air ports 12 in the center part of the boiler wall. Air ports in the center part of the boiler wall have a greater hydraulic diameter to enable better air penetration to the center parts of the boiler than the smaller ports in the corner areas.

Figure 5:
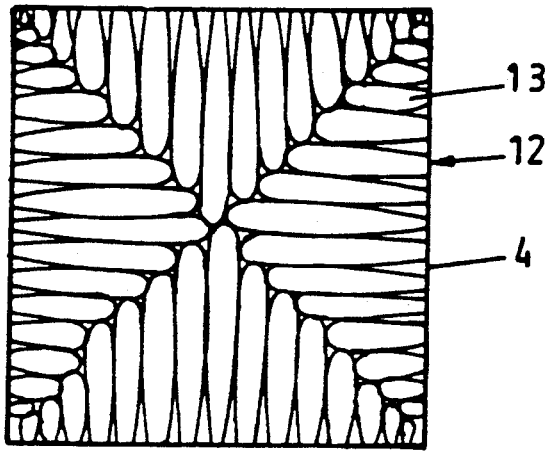
FIG. 5 illustrates the penetration of air jets in accordance with the invention over the cross-sectional area of a boiler.

FIG. 5 illustrates an air supply profile in accordance with the invention, a so called envelope-shaped profile, for the cross-sectional area of the boiler. Air jets 13 supplied through air ports 12 of different sizes penetrate into the boiler according to the size of the opening. From the center parts of the boiler walls, the air jets extend to the center part of the boiler, and from the corner areas of the boiler wall only a short distance towards the inside. As can be seen from FIG. 5, the extent of penetration for each wall increases gradually from a minimum in the corner to a maximum at the center of the wall. As a result, sufficient penetration to the center part of the boiler is achieved so that the combustion air also, partly mixes with the "droplet lift" flowing upwards in the center. At the same time, the interlacing of the air jets is avoided in the corner areas of the boiler. Thus an advantageous air supply is achieved for the entire cross-sectional area of the boiler without any great surplus amounts of air, and without any empty areas.

When the loading changes, it is possible to maintain the penetration Lp of air jets constant by changing the above mentioned variants in the formula $$L_p = k \times D_n \times V_n / V_f (T_f / T_n)^{0 \times 5}.$$

The size of the openings, the speed of the air jet, or the inlet air temperature may be varied so as to maintain the penetration constant. It is also possible to increase the penetration by decreasing the temperature of an air jet. Penetration may be respectively decreased, if required, by constricting the air ports by the above mentioned valves.

Figure 6:
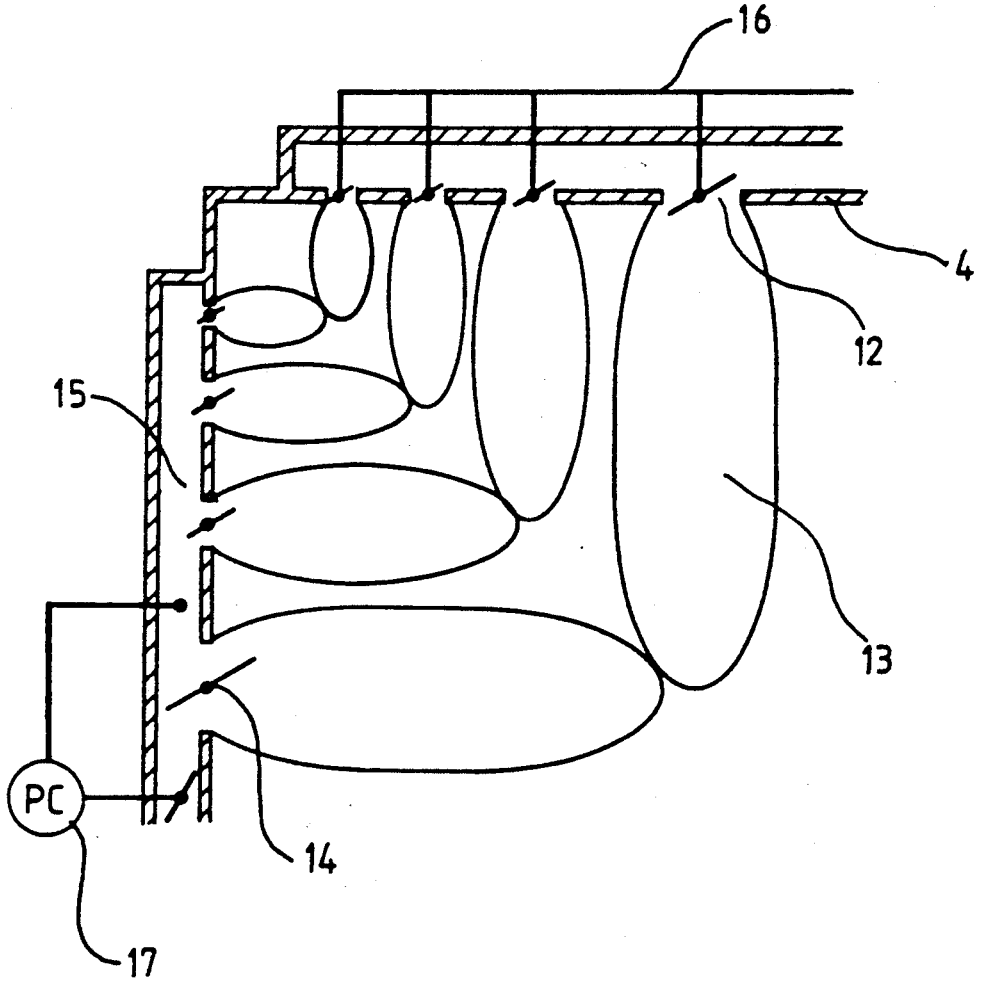
FIG. 6 is a partial enlargement of FIG. 5 and further illustrates the manner in which air jets are introduced from wind boxes under the control of damper devices and a pressure controller.

With reference to FIG. 6, there is shown an enlarged portion of FIG. 5 illustrating in more detail the penetration of air jets into a soda recovery boiler. As already noted, air is introduced to the air ports 12 from wind boxes 15 with dampers 14 being used to adjust the air flow rate as appropriate when the loading conditions change. In other words, the dampers 14 are used in the air ports for adjusting the hydraulic diameters of the air ports. The dampers 14 may be arranged on a main shaft 16 by which it is possible to adjust several dampers simultaneously. The air pressure in the wind box is controlled by a pressure control device 17.

Figure 7:
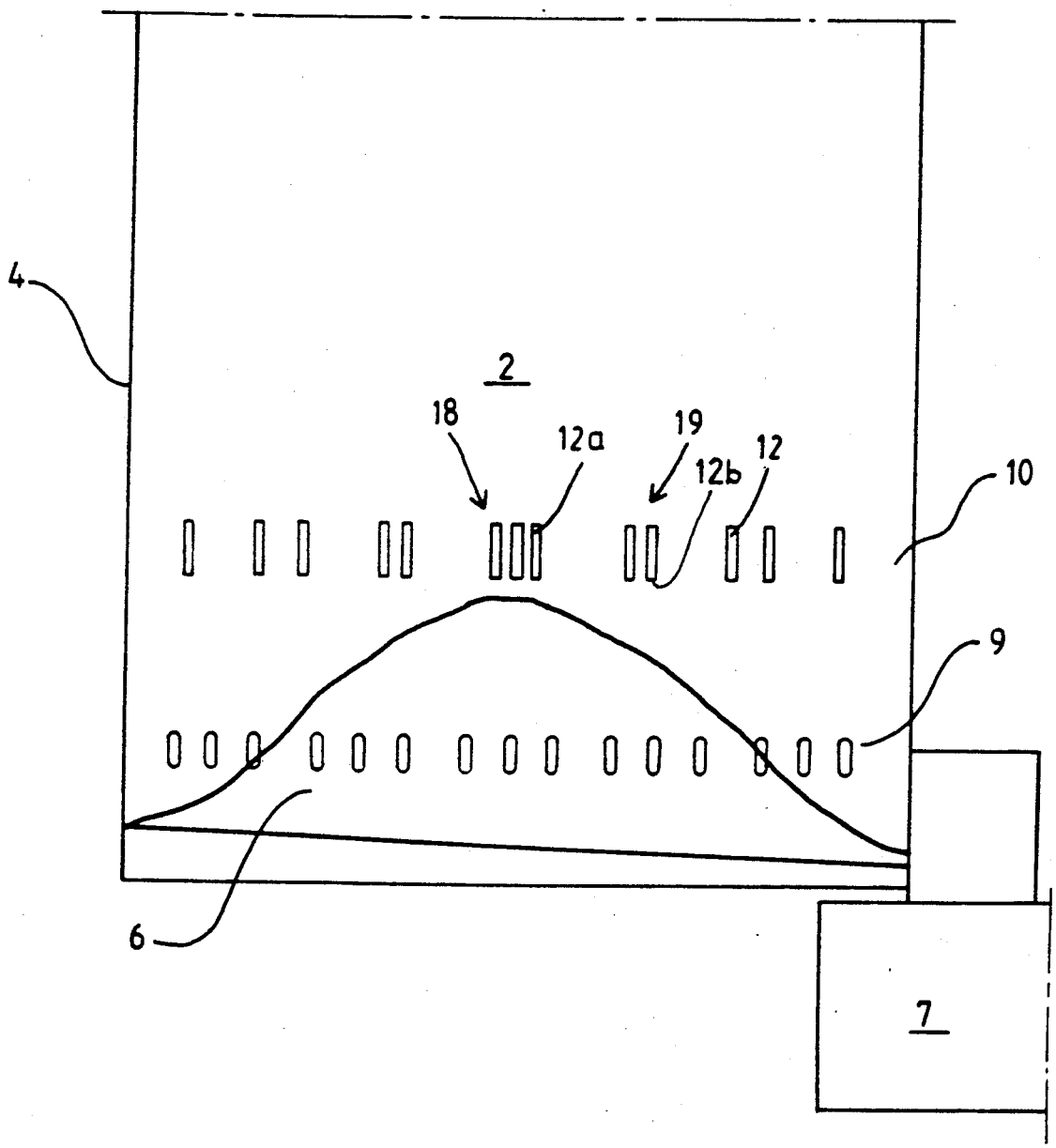
FIG. 7 discloses an arrangement similar to FIG. 4 but wherein a plurality of air ports are located within the effective range of each other.

Turning now to FIG. 7, the hydraulic diameters of the air ports may be increased by providing at least two (three are shown in the exemplary embodiment of FIG. 7) ports 12A within the effective range of each other in the middle of a furnace wall, thereby forming a group 18 of air ports having a combined hydraulic diameter greater than the individual air ports 12 or smaller groups 19 of air ports 12B which are closer to the corner of the furnace.

It will be understood that the apparatus as described hereinabove is applicable not only to soda recovery boilers but also to other furnaces, such as grate furnaces.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of introducing combustion air in air jet form to a furnace having a plurality of walls from a plurality of air ports arranged at a substantially similar level in different walls of the furnace, comprising the steps of: introducing combustion air into the furnace in air jet form from at least two opposing furnace walls, said jets having at least two different sizes such that penetration of the air jets increases from corners of the furnace towards centers of the said at least two opposing furnace walls.

2. A method in accordance with claim 1, wherein combustion air is introduced from four walls of the furnace in air jets of different sizes such that penetration of the air jets increases from the corners of the furnace towards the center of each of said four walls.

3. A method in accordance with claim 1, and including the step of maintaining the penetration of the air jets substantially constant at varying loading conditions according to the formula $$L_p = k \times D_n \times V_n / V_f (T_f / T_n)^{0.5}$$

where

Lp=penetration;

Dn=hydraulic diameter, and

Vn=air flow rate, by adjusting one or more of the hydraulic diameter of the air ports, the air flow rate in the air ports, and the temperature of the inlet air so that the air jets cover substantially the entire cross-sectional area of the furnace at different loading conditions.

4. A method in accordance with claim 1, wherein the furnace is a soda recovery boiler, and wherein the method includes the step of introducing secondary air into the boiler by air jets, and maintaining penetration of said air jets substantially constant at different loading conditions.

5. A method in accordance with claim 2, wherein the air jets form an envelope-shaped air supply profile over the cross-sectional area of the furnace.

6. A method in accordance with claim 1, wherein the penetration of the air jets is controlled by dampers.

7. A method in accordance with claim 6, wherein the penetration of air jets is controlled in groups by dampers arranged on a main shaft.

8. A method in accordance with claim 1, wherein the penetration of air jets is controlled by adjusting air pressure in wind boxes supplying air to said ports.

9. Apparatus for supplying combustion air to a furnace, the furnace having at least four walls, each of which is provided with a plurality of adjacent air ports in communication with a supply of air, said air ports being configured such that hydraulic diameters of said ports increase from corners of the furnace towards center portions of said furnace walls.

10. Apparatus in accordance with claim 9, wherein cross-sectional areas of said air ports increase from the corners of the furnace towards said center portions of said furnace walls.

11. Apparatus in accordance with claim 9, wherein two or more small air ports are located within effective range of each other in the center portion of at least one of said furnace walls in such a way that the combined hydraulic diameter of said two or more air ports is greater than the hydraulic diameter of individual air ports arranged close to the corners of the furnace.

12. Apparatus in accordance with claim 9, wherein the distance between the air ports diminishes from said center portions of said furnace walls towards said corners of the furnace.

13. Apparatus in accordance with claim 9, wherein said apparatus includes means for introducing combustion air to a soda recovery boiler.

14. Apparatus in accordance with claim 13, and further including means for introducing secondary air to the soda recovery boiler.

15. Apparatus in accordance with claim 9, wherein said apparatus includes means for introducing combustion air to a grate furnace.

16. Apparatus in accordance with claim 9, wherein dampers are arranged in the air ports so as to control the inlet pressure of the air being introduced to the furnace.

17. Apparatus in accordance with claim 16, wherein dampers are connected in groups on a main shaft such that said groups of dampers may be adjusted substantially.

* * * * *

UNITED STATES PATENT AND TRADEMARK OFFICE

CERTIFICATE OF CORRECTION

PATENT NO. : 5,022,331

DATED : June 11, 1991

INVENTOR(S) : Liisa I. Simonen

It is certified that error appears in the above-identified patent and that said Letters Patent is hereby corrected as shown below:

On the Title page, the address of the Assignee should read --Noormarkku, Finland--.

Signed and Sealed this

Fifteenth Day of December, 1992

*Attest:*

DOUGLAS B. COMER

*Attesting Officer*

*Acting Commissioner of Patents and Trademarks*